US009427950B2

(12) United States Patent
Oshio et al.

(10) Patent No.: US 9,427,950 B2
(45) Date of Patent: Aug. 30, 2016

(54) PLATE MAKING METHOD AND SCREEN MASTER

(71) Applicant: RISO KAGAKU CORPORATION, Minato-ku, Tokyo (JP)

(72) Inventors: Susumu Oshio, Tsukuba (JP); Kazuo Nakano, Tsukuba (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/819,996

(22) Filed: Aug. 6, 2015

(65) Prior Publication Data

US 2016/0059539 A1 Mar. 3, 2016

(30) Foreign Application Priority Data

Aug. 28, 2014 (JP) ..... 2014-174064

(51) Int. Cl.
*B41C 1/14* (2006.01)
*B41C 1/055* (2006.01)
*B41N 1/00* (2006.01)

(52) U.S. Cl.
CPC ..... *B41C 1/055* (2013.01); *B41C 1/147* (2013.01); *B41N 1/00* (2013.01)

(58) Field of Classification Search
CPC ..... B41C 1/055; B41C 1/145; B41C 1/147; B41C 1/148; B41C 1/14; B41F 15/36; B41N 1/245; B41N 1/243; B41N 1/24
USPC ..... 101/128.21, 128.4
See application file for complete search history.

(56) References Cited

U.S. PATENT DOCUMENTS 5,924,359 A * 7/1999 Watanabe ..... B41C 1/147 101/127
5,924,361 A * 7/1999 Watanabe ..... B41C 1/147 101/128.21
6,593,001 B1 * 7/2003 Watanabe ..... B41C 1/147 428/464

FOREIGN PATENT DOCUMENTS

JP S62-50136 A 3/1987

* cited by examiner

*Primary Examiner* — Blake A Tankersley
(74) *Attorney, Agent, or Firm* — Manabu Kanesaka

(57) ABSTRACT

An ink image is formed on the side of a gauze of a screen master by discharging ink by an ink discharge apparatus, and collected visible rays or infrared rays are irradiated onto the ink image to heat the ink. Then, a thermoplastic resin film is perforated to form a plate making image corresponding to the ink image. The minute ink drops discharged from the ink discharge apparatus are held inside minute opening portions (pixels) of fibers configuring the gauze, and are put on the thermoplastic synthetic resin film bent by gravity. Thermo-sensitive perforation is carried out in this state, and thus a high-definition plate making image corresponding to the image configured using the ink drops in units of pixels can be obtained.

2 Claims, 4 Drawing Sheets

PLATE MAKING METHOD AND SCREEN MASTER

RELATED APPLICATION

The present application is based on, and claims priority from, Japanese Application No. JP2014-174064 filed Aug. 28, 2014, the disclosure of which is hereby incorporated by reference herein in its entirety.

TECHNICAL FIELD

The present invention relates to a screen master formed by pasting a thermoplastic resin film made of polyester or polyvinyl chloride to a gauze configured in a mesh shape by regularly weaving with fibers such as silk, nylon, or Tetoron (registered trademark), and a plate making method thereof, and particularly to a screen master and a plate making method thereof by which high-resolution plate making can be performed in units of minute opening portions of the gauze.

BACKGROUND OF ART

The invention disclosed in Japanese Unexamined Patent Application Publication No. Sho 62(1987)-50136 relates to a plate making method of thermosensitive stencil base paper formed by pasting a porous support member capable of ink copying to a thermoplastic synthetic resin film. According to the plate making method, a conductive layer is provided on a surface of the thermoplastic synthetic resin film of the thermosensitive stencil base paper, a photosensitive layer having photoconductive properties is further provided thereon, and a black toner layer is formed on the photosensitive layer by an electrophotographic system. A toner image is heated by irradiating flash of a xenon lamp including infrared rays to melt and perforate the film of a part corresponding to the toner image, and a plate making image is formed. According to the invention, unlike a method in which infrared rays are irradiated while closely attaching a document to a film, it is not necessary to closely attach the document to the film. Thus, a material other than the sheet document can be printed, and the resolution is increased as compared to a case of perforating while closely attaching the document to the film because the toner image is formed on the film without contaminating the document.

SUMMARY OF INVENTION

Technical Problem

The plate making method disclosed in Japanese Unexamined Patent Application Publication No. Sho 62(1987)-50136 is a method of plate making of thermosensitive stencil base paper, and the thermosensitive stencil base paper is configured by pasting a thermoplastic resin film to a porous support member such as Japanese paper. As a printing plate similar to the thermosensitive stencil base paper, a screen master obtained by pasting a thermoplastic resin film to a material referred to as a gauze configured in a mesh shape by regularly weaving with fibers is known. However, in the case where the plate making method of thermosensitive stencil base paper disclosed in Japanese Unexamined Patent Application Publication No. Sho 62(1987)-50136 is applied to the plate making of the screen master, a high-resolution plate making image cannot be necessarily obtained as described in Japanese Unexamined Patent Application Publication No. Sho 62(1987)-50136.

The reason is as follows: in the case where the screen master is made by the plate making method disclosed in Japanese Unexamined Patent Application Publication No. Sho 62(1987)-50136, an image is formed on a surface of a film using black toner, and the film is melted and perforated by heating the plate making image to form the plate making image. In this case, the plate making image configured using the holes formed in the film is not formed in units of minute opening portions (hereinafter, referred to as pixels) of the gauze having a mesh structure, and thus is not shaped in accordance with the image formed on the surface of the film using the black toner.

Specifically, the image of the black toner is formed on a surface of the film irrespective of a group of minute pixels of the gauze that are regularly, horizontally and vertically arranged. Thus, in the case where the image of the black toner is heated to melt the film, it is difficult to predict the behavior of the melted film by being affected by the fibers or pixels of the gauze located near the melted film.

For example, if a part of the image of the black toner is associated with the entirety of a certain pixel, the film of the part is melted and degenerated while being associated with the entirety of the pixel at the time of plate making, and is entangled with the fibers of the gauze. Thus, the entire pixel may be perforated. However, if a part of the image of the black toner is associated with only a part of a certain pixel, the film of the part is not completely melted, or not melted at all. As described above, in the case where the screen master is made by the plate making method disclosed in Japanese Unexamined Patent Application Publication No. Sho 62(1987)-50136, the image of the black toner is formed irrespective of minute pixels provided with the gauze of the screen master. On the basis of the principle, obtaining a high-definition plate making image true to minute pixels of the gauze cannot be expected.

The present invention has been made in view of the foregoing background art and problems, and an object of the present invention is to provide a plate making method in which high-resolution plate making can be carried out in units of minute pixels configuring opening portions of a gauze of a screen master at the time of plate making of the screen master.

Solution to Problem

According to a first aspect of the invention, there is provided a plate making method of a screen master formed by pasting a gauze and a thermoplastic resin film to each other, the method including the steps of: discharging ink by an ink discharge apparatus to form an ink image on the side of the gauze of the screen master; and melting the thermoplastic resin film by heating the ink after irradiating collected visible rays or infrared rays onto the ink image from the side of the gauze to form a plate making image corresponding to the ink image.

According to a second aspect of the invention, there is provided a plate making method of a screen master formed by pasting a gauze and a thermoplastic resin film to each other, the method including the steps of: forming an ink holding layer made of material having an excellent affinity for ink on the side of the gauze of the screen master; discharging ink by an ink discharge apparatus to form an ink image on the side of the gauze of the screen master; and melting the thermoplastic resin film by heating the ink after irradiating collected visible rays or infrared rays onto the ink image from the side of the gauze to form a plate making image corresponding to the ink image.

According to a third aspect of the invention, there is provided a screen master formed by pasting a gauze and a thermoplastic resin film to each other, wherein an ink holding layer made of material having an excellent affinity for ink is provided on the side of the gauze.

According to a fourth aspect of the invention, there is provided a plate making apparatus that forms a plate making image on a screen master formed by pasting a gauze and a thermoplastic resin film to each other, the apparatus including: an ink discharge apparatus that forms an ink image by discharging ink on the side of the gauze of the screen master; and an irradiation unit of visible rays or infrared rays that melts the thermoplastic resin film by heating the ink after irradiating collected visible rays or infrared rays onto the ink image from the side of the gauze to form a plate making image corresponding to the ink image.

Advantageous Effects of Invention

According to the plate making method described in the first aspect of the invention and the plate making apparatus described in the fourth aspect of the invention, the minute ink drops are discharged from the ink discharge apparatus to the side of the gauze of the screen master. These minute ink drops are discharged to the minute opening portions regularly partitioned by the fibers configuring the gauze, namely, the respective inner portions of plural pixels, and are put on the thermoplastic synthetic resin film. In this case, the middle portion of each pixel of the thermoplastic synthetic resin film pasted to the fibers of the gauze is bent by gravity, and is formed in a shape protruding to the side opposite to the gauze (or hung shape). Thus, the ink drops put in each pixel are gathered in the middle of each pixel where the film is recessed. Specifically, the ink image configured using the minute ink drops discharged by the ink discharge apparatus is configured in units of pixels of the gauze of the screen master. In this case, if collected visible rays or infrared rays are irradiated onto the ink image to heat the ink located in the middle of each pixel, the thermoplastic resin film is melted by the heat and can be perforated in units of pixels. In addition, a high-definition plate making image (perforated image) corresponding to the ink image configured using the ink drops in units of pixels can be obtained. Specifically, the obtained plate making image is configured using a set of pixels of the gauze where the opening potions are formed by melting the thermoplastic resin film, and thus the resolution degree is high.

According to the plate making method described in the second aspect of the invention and the screen master described in the third aspect of the invention, the ink image is formed by discharging ink by the ink discharge apparatus to the side of the gauze of the screen master on which the ink holding layer made of material having an excellent affinity for ink is formed. The gaps of the fibers between the pixels of the gauze of the screen master are filled with the ink holding layer. Thus, the ink drops discharged to the inside of each pixel are reliably held in the ink holding layer throughout the four corners of each pixel. Specifically, the ink image configured using the ink drops discharged by the ink discharge apparatus is formed in units of pixels of the gauze of the screen master, and is configured by the all pixels. In this case, if collected visible rays and infrared rays are irradiated onto the ink image to heat the ink put in the all pixels, the thermoplastic resin film can be perforated in units of pixels throughout the all pixels, and a high-definition plate making image (perforated image) corresponding to the ink image configured using the ink drops in units of pixels can be obtained. Specifically, the obtained plate making image is configured using a set of pixels of the gauze that are fully opened by melting the thermoplastic resin film, and thus the resolution degree is high.

It should be noted that there are two possible methods to provide the ink holding layer on the side of the gauze of the screen master in the plate making method described in the second aspect of the invention and the screen master described in the third aspect of the invention. The first method is a method in which the ink holding layer is formed on one surface of the thermoplastic resin film, and then the one surface is bonded to the gauze. The second method is a method in which a formation liquid containing material of which the ink holding layer is made is applied from the side of the gauze of the screen master as a finished product, followed by drying.

The ink can reliably reach the four corners of each pixel by any one of the methods. Thus, after carrying out the plate making in which the thermoplastic resin film is melted by heating the ink by irradiating collected visible rays or infrared rays, the melted thermoplastic resin film is entangled and solidified at the intersection points of the fibers of the gauze. Thus, the bonding strength between the fibers of the gauze and the thermoplastic resin film is increased.

DESCRIPTION OF EMBODIMENTS

Figure 1:
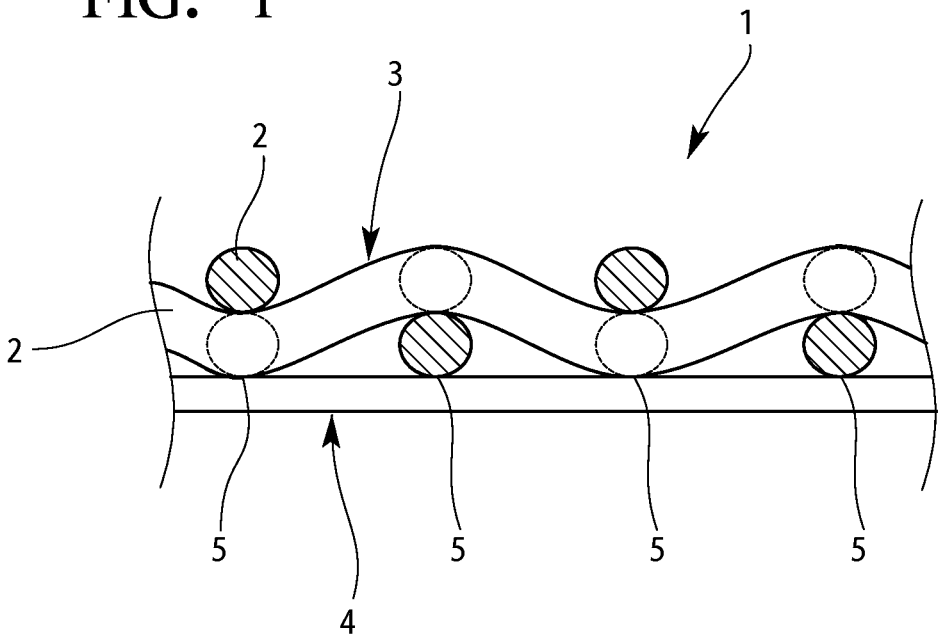
FIG. 1 is a cross-sectional view of a general screen master used in the present invention.

Hereinafter, the content of the technical research conducted by the inventors of the present application before achieving the present invention, the present invention achieved as a result of the research, and the embodiments will be described in order with reference to the drawings.

It should be noted that the same or equivalent parts and constitutional elements are given the same or equivalent reference numerals throughout the all drawings. Further, in the case where the number of same parts and constitutional elements to be denoted by the same reference numerals is large, only some parts and constitutional elements are occasionally given the reference numerals to avoid complication of illustration. It should be noted that the drawings are schematically illustrated, and are different from the actual parts and constitutional elements. Further, it is obvious that the mutual relations of dimensions and ratios are partially different among the drawings.

Further, the embodiments shown below exemplify an apparatus and the like to embody technical ideas of the present invention, and the technical ideas of the present invention do not limit the arrangement and the like of each constitutional part to those shown below. The technical ideas of the present invention can be variously changed in claims.

FIG. 1 is a cross-sectional view of a general screen master 1. The screen master 1 is a kind of printing plate configured by pasting a thermoplastic resin film 4 made of polyester or polyvinyl chloride onto a sheet-like material referred to as a gauze 3 formed in a mesh shape by regularly weaving with fibers 2 such as silk, nylon, or Tetoron (registered trademark). The mesh of the gauze 3 is configured using squares or compartments formed by horizontally and vertically weaving with the fibers 2, and each square or compartment is formed in a quadrangular shape in plan view.

A screen master and a plate making method of the present invention (first embodiment)

As described above in each section of {Technical Problem}, {Solution to Problem}, and {Advantageous Effects of Invention}, minute quadrangular opening portions (the squares or compartments) of the gauze 3 having a mesh-like structure in the screen master 1 are referred to as pixels 6 in the embodiment of the present invention for the sake of convenience. As will be described below in detail, unlike a case where the conventional technique is applied to the screen master 1, a plate making image (perforated image) obtained by perforating the thermoplastic resin film 4 or a printed image formed on the basis of the plate making image is configured using the opening portions as a minimum unit in the embodiment. Thus, it is conceivable that the opening portions correspond to pixels configuring the plate making image or printed image in the plate making technique or image forming technique.

Therefore, the idea of referring to the opening portions of the gauze 3 of the screen master 1 as "pixels" is not produced on the basis of the above-described conventional technique or the scope of the technical idea of the ink plate making using the screen master 1 conducted by the inventors of the present application.

Figure 2:
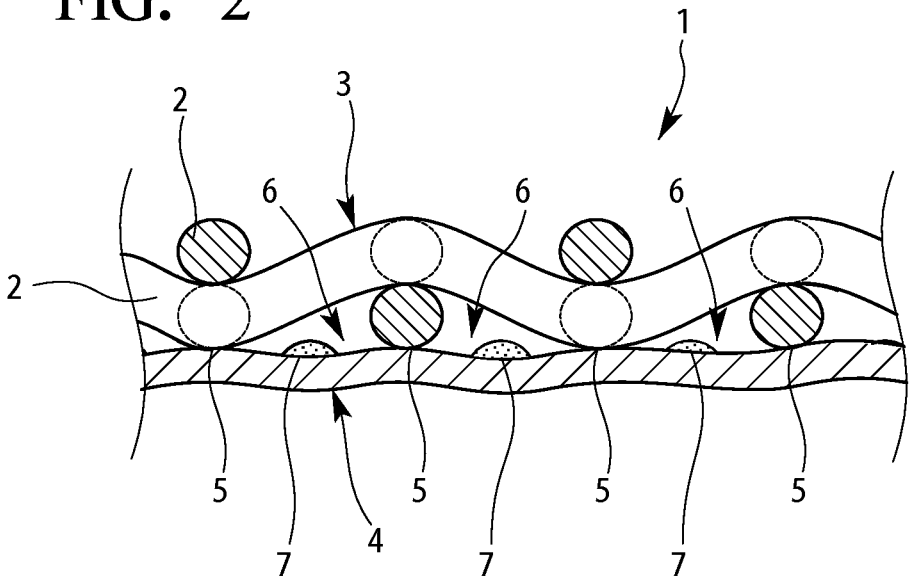
FIG. 2 is a cross-sectional view for showing a state in which a plate making image is formed by supplying ink drops by an ink discharge apparatus to each pixel of the screen master in a first embodiment of the present invention.
Figure 3:
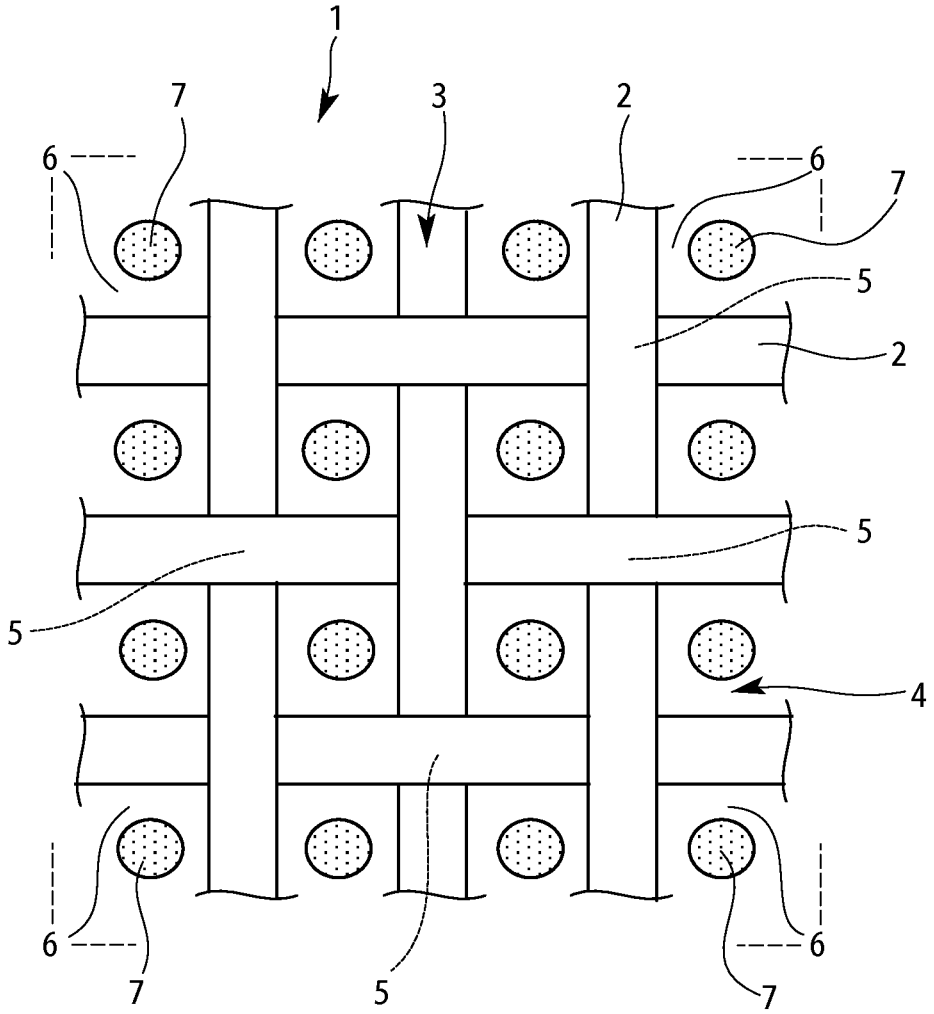
FIG. 3 is a plan view for showing a state in which the plate making image is formed by supplying the ink drops by the ink discharge apparatus to each pixel of the screen master in the first embodiment of the present invention.

FIG. 2 is a cross-sectional view of the screen master 1 of the first embodiment, and FIG. 3 is a plan view thereof. Each drawing shows the same structure as the general screen master 1 having the regular pixels 6 described with reference to FIG. 1, and illustrates a state after an ink image is formed using ink drops 7.

As shown in FIG. 1 and FIG. 2, in the plate making method of the embodiment, the screen master 1 is horizontally stretched with the side of the gauze 3 facing upward, and the ink drops 7 that can be stored in the respective pixels 6 are discharged by an ink jet head as an ink discharge apparatus from the upper side, namely, the side of the gauze 3 to form a desired ink image.

As the size of each pixel 6 in the screen master 1, for example, the longitudinal and lateral dimensions are about 60 to 300 μm. Further, the amount of one ink drop of the ink jet head can be adjusted in the range of, for example, 1 to 10 pL, and the amount of ink that can be discharged at a time can be arbitrarily adjusted by adjusting the number of ink drops 7 if necessary.

In the embodiment, the amount of ink drops 7 discharged by the ink jet head is appropriately adjusted in accordance with the actual size of each pixel 6. Accordingly, the ink drops 7 can be discharged so as to be gathered in the middle of each pixel 6 located in an area where an image is formed using the ink as shown in FIG. 1 and FIG. 2. In this case, the thermoplastic resin film 4 bonded to the fibers 2 is pulled downward and hangs by gravity between attachment points 5 with respect to the fibers 2 in the respective pixels 6 of the screen master 1, and is in a shape protruding in the direction opposite to the gauze 3. Specifically, when viewed from the upper side or the side of the gauze 3, the thermoplastic resin film 4 is concaved by being pulled downward in the middle of each pixel 6. Therefore, the dropped ink drops 7 are stabilized in the concaved film 4, and the film 4 is gathered in the middle of each recessed pixel 6. Specifically, the ink image configured using the minute ink drops 7 discharged by the ink jet head is configured in units of the pixels 6 of the gauze 3 of the screen master 1.

In this case, if collected visible rays or infrared rays are irradiated onto the ink image and the ink located in the middle of each pixel 6 is heated, the perforated holes can be formed in the thermoplastic resin film 4 in units of the pixels 6. In addition, a high-definition ink image associated with the image configured in units of the pixels 6 using the ink drops 7 can be obtained. Specifically, if the thermoplastic resin film 4 attached to the gauze 3 while being stretched with a certain amount of tension is perforated by heat in the middle of each pixel 6, the thermoplastic resin film 4 is momentarily degenerated, and each pixel 6 is reliably opened. Thus, the obtained plate making image is configured using a set of pixels 6 of the gauze 3 that are opened by melting the thermoplastic resin film 4, is true to the image formed of the ink, and is high in resolution. Accordingly, if screen printing is performed using the screen master 1 made as described above, a high-definition printed image true to the original image can be formed.

Figure 4:
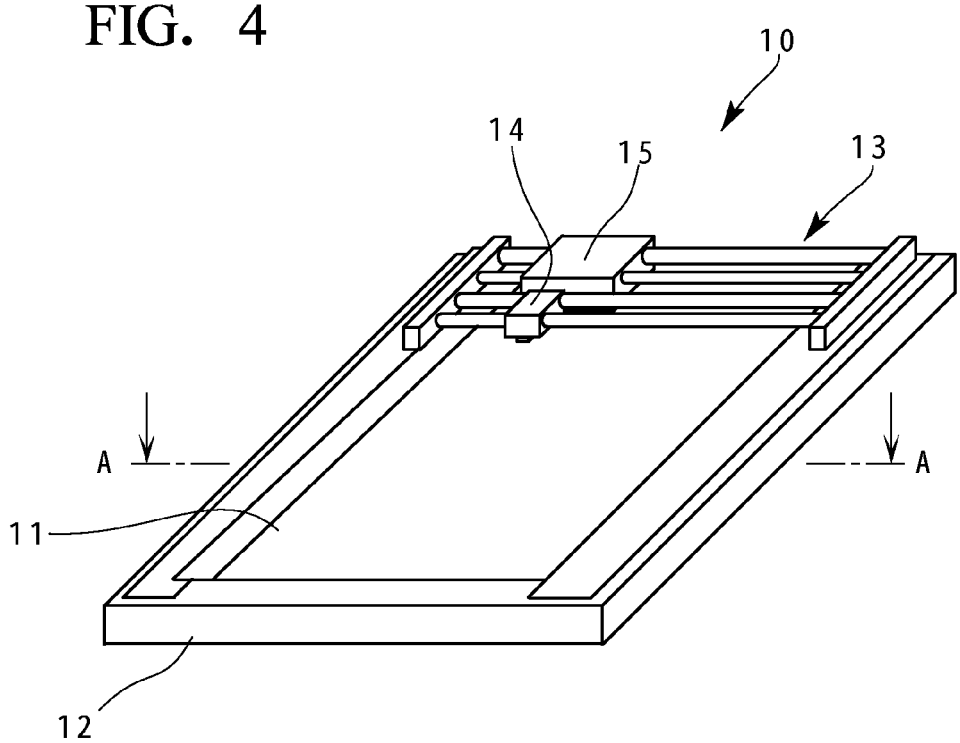
FIG. 4 is a perspective view of the ink discharge apparatus and a plate making apparatus as an irradiation apparatus of collected visible rays or infrared rays that can be used in the first embodiment of the present invention.
Figure 5:
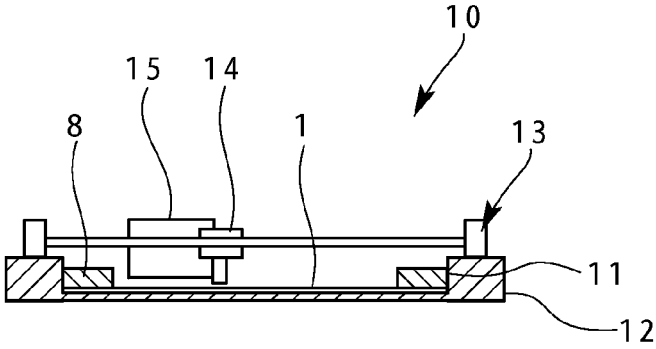
FIG. 5 is a cross-sectional view of the plate making apparatus taken along the cut line A-A shown in FIG. 4.

FIG. 4 is a perspective view of a plate making apparatus 10 as an ink discharge apparatus and an irradiation apparatus of collected visible rays or infrared rays that can be used in the first embodiment, and FIG. 5 is a cross-sectional view taken along the line A-A of FIG. 4.

When the plate making apparatus 10 shown in FIG. 4 is used, the side of the gauze 3 of the screen master 1 is pasted onto a frame body 8 as shown in FIG. 5, and the screen master 1 is set to the plate making apparatus 10 with the frame body 8 and the side of the gauze 3 facing upward. The plate making apparatus 10 includes a quadrangular plate-like base 12 with a concaved part 11. The screen master 1 pasted onto the frame body 8 can be held in the concaved part 11 of the base 12. On an upper surface of an outer circumferential frame of the base 12, a moving mechanism 13 is provided that can move an object in the horizontal and vertical directions of the base 12, namely, the X and Y directions that are orthogonal to each other in a horizontal plane on the concaved part 11 of the base 12. The moving mechanism 13 is provided with an ink jet head 14 as an ink discharge apparatus, and a lamp unit 15 as an irradiation unit of collected visible rays or infrared rays, and can set the ink jet head 14 and the lamp unit 15 at desired positions of the screen master 1 installed in the concaved part 11 of the base 12. The ink jet head 14 is driven while operating the moving mechanism 13, so that a desired image can be formed of ink on the screen master 1 from the side of the gauze 3. Further, the lamp unit 15 is driven while operating the moving mechanism 13, so that a plate making image can be formed in such a manner that light is irradiated onto an image formed of ink on the side of the gauze 3 of the screen master 1, and the film 4 of the screen master 1 is melted and perforated by heat of the ink.

A screen master and a plate making method of the present invention (second embodiment)

Figure 6:
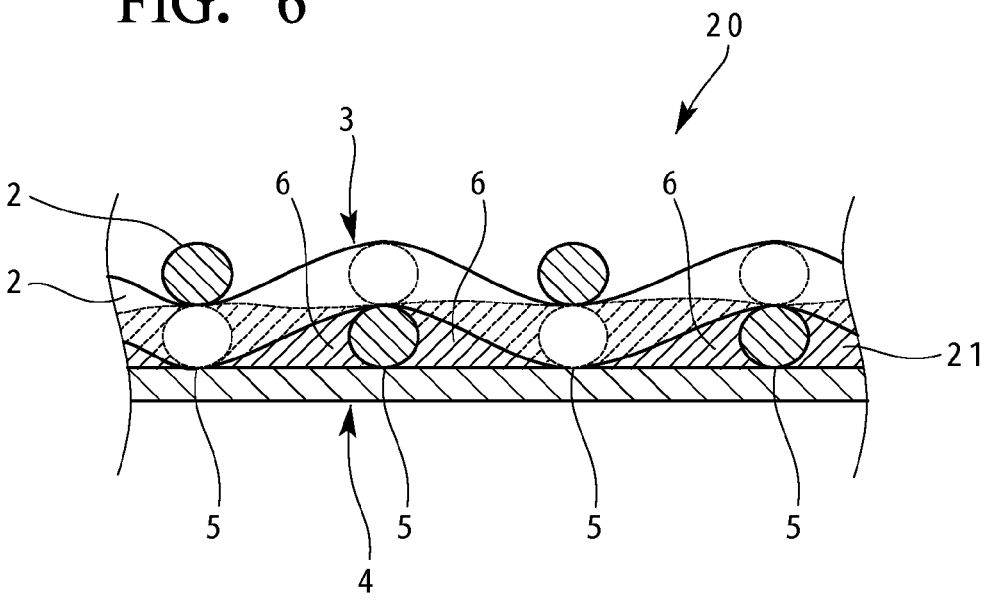
FIG. 6 is a cross-sectional view of a screen master according to a second embodiment of the present invention.

FIG. 6 is a cross-sectional view of a screen master 20 of the embodiment. The basic structure of the screen master 20 itself is the same as that of the general screen master 1 as described above, and thus the explanation thereof will not be repeated. Further, the plate making apparatus 10 for carrying out a plate making method of the second embodiment is the same as that of the first embodiment.

The screen master 20 of the embodiment is provided with an ink holding layer 21 made of material having an excellent affinity for ink on the side of the gauze 3. In FIG. 6, oblique lines other than the fibers 2 and the thermoplastic synthetic resin film 4 correspond to the ink holding layer 21. In this case, the excellent affinity for ink means having hydrophilicity (anti-hydrophobic property) in the case of water-based ink, and having lipophilicity (anti-lipophobic property) in the case of oil-based ink.

The ink holding layer 21 is a material layer for absorbing and holding ink, and is formed on the side of the gauze 3 of the screen master 20. More specifically, the ink holding layer 21 is preferably provided to fill at least gaps between the fibers 2 and the thermoplastic resin located other than the attachment points 5 of the fibers 2 of the gauze 3 and the thermoplastic resin film 4, or is preferably provided to fill the gaps and to fill a part or almost all of the inside of each pixel 6 of the gauze 3.

The ink holding layer 21 is provided inside each pixel 6, so that the ink drops 7 supplied to each pixel 6 by the ink jet head 14 of the plate making apparatus 10 are directly absorbed and held at a position apart from the fibers 2 configuring the gauze 3, and the amount of ink larger than that entangled and absorbed by the fibers 2 configuring the gauze 3 can be held inside each pixel 6.

Such an ink holding layer 21 needs to contain material having an excellent affinity for ink as described above, for example, inorganic particles. Further, in order to form a layer containing inorganic particles in each pixel 6, a formation liquid containing the inorganic particles in an appropriate dispersed state is prepared. In addition, it is necessary to apply the formation liquid from the side of the gauze 3 of the screen master 20 and to dry the same. Other than the inorganic particles, the formation liquid needs to contain, at least, resin as a fixing agent, an additive agent such as a preservative to be added if necessary, and a solvent (for example, water) for dissolving these agents.

The following is an example of components of the formation liquid to form the ink holding layer 21 on the side of the gauze 3 of the screen master 20 (represented by weight ratio).

| | |
|---|---|
| Silica particles as inorganic particles | 15% |
| Polyvinyl alcohol | 5% |
| Water-based emulsion resin (styrene/acrylic type and the like) | 3% |
| Preservative | 0.1% |
| Water | residual quantity |

Examples of more detailed components and a production method of the formation liquid to form the ink holding layer 21 provided in the screen master 20 of the embodiment will be described.

The formation liquid contains, at least, inorganic particles, water, and a solvent.

The inorganic particles are inorganic particles with an average particle diameter of 1 to 20 μm measured by a laser light diffraction scattering method. In this case, the average particle diameter measured by the laser light diffraction scattering method is measured by a laser light diffraction scattering particle size distribution measuring apparatus, in more detail, an apparatus having the trade name of SALD-2000A (manufactured by SHIMADZU CORPORATION) under the conditions of a laser light wavelength of 680 nm, a measured temperature of 25° C., and water as a dispersion medium. Even in the case where the average particle diameter is smaller than 1 μm and the average particle diameter is larger than 20 μm, an ink holding effect cannot be sufficiently obtained.

As the inorganic particles, inorganic particles used as an extender pigment can be used. For example, other than the above-described silica, inorganic particles such as calcium carbonate, barium sulfate, titanium oxide, alumina white, aluminum hydroxide, white clay, talc, clay, diatomaceous earth, kaolin, and mica can be preferably used.

More than 10% by weight of inorganic particles relative to the entire formation liquid is contained. The content is preferably 20 to 50% by weight, and more preferably 25 to 35% by weight. If the content of the inorganic particles is smaller than 10% by weight, the amount of formation liquid to be applied needs to be increased in order to sufficiently obtain the ink holding effect. Thus, drying characteristics are deteriorated, and the formation liquid is not suitable for a high-speed process.

The formation liquid is preferably applied to the screen master 20 so that the amount of formation liquid is 10 to 15 $g/m^2$. The amount of formation liquid is more preferably 11 to 14 $g/m^2$, and still more preferably 12 to 13 $g/m^2$. If the amount of formation liquid is smaller than 10 $g/m^2$, the ink holding effect is deteriorated. On the other hand, if the amount of formation liquid is larger than 15 $g/m^2$, drying characteristics are deteriorated, and the formation liquid is not suitable for a high-speed process.

The formation liquid may contain a solvent. As a solvent, glycols such as ethylene glycol (SP value=14.2), diethylene glycol (SP value=12.1), propylene glycol (SP value=13.3), and butylene glycol (SP value=13.8), and diols such as glycerin (SP value=16.5), 1.3-propanediol (SP value=13.5), and butanediol (SP value=13.6) can be used.

In addition to the above-described solvent and inorganic particles, other components such as a dispersant, a surface-active agent, a fixing agent, and a preservative can be added to the formation liquid used in the second embodiment unless the components have adverse effects on the property. In particular, the fixing agent is useful to provide the durability of the formation liquid-applied layer and to prevent bleeding of the printed image. As the fixing agent, various types of water-soluble polymer particles or water-dispersible polymer particles can be used. As the types of polymer, an acrylic acid copolymer, an acrylic/styrene copolymer, polyurethane, polyester, polyvinyl alcohol, polyvinyl chloride, polyvinyl acetate, styrene-butadiene rubber (SBR), starch, alkyd resin, polyacrylamide, polyvinyl acetal, and the like are preferable.

The formation liquid used in the second embodiment can be prepared in such a manner that, for example, all components are collectively or partially put and dispersed in a well-known disperser such as a bead mill, and are filtered by a well-known filter such as a membrane filter if necessary. For example, the formation liquid can be prepared in such a manner that a mixed liquid obtained by mixing a certain amount of solvent with the whole amount of pigment is preliminarily prepared and dispersed in a disperser, and then the remaining components are added to the dispersion liquid to be filtered by a filter.

There are two possible methods to provide the ink holding layer 21 on the side of the gauze 3 of the screen master 20 using the above-described formation liquid.

The first method of providing the ink holding layer 21 is a method (first method) in which the formation liquid is applied to the entire one surface of the thermoplastic resin film 4, followed by drying, the ink holding layer 21 is formed, and then the one surface on which the ink holding layer 21 is formed is bonded to the gauze 3.

The second method of providing the ink holding layer 21 is a method in which the formation liquid is applied from the side of the gauze 3 of the screen master 20 as a finished product, followed by drying.

The ink can be reliably held throughout the four corners of each pixel 6 by the ink holding layer by using any one of the methods. Thus, when an image is formed by discharging the ink by the ink jet head 14 of the plate making apparatus 10, the ink discharged to each pixel 6 can be reliably held by the ink holding layer 21. Therefore, the resolution of the plate making image or the definition degree of the printed image is high. Further, the thermoplastic resin film 4 melted at the intersection points (or attachment points 5) of the fibers 2 of the gauze 3 is entangled and solidified after the plate making, and thus the bonding strength between the fibers 2 of the gauze 3 and the thermoplastic resin film 4 is increased.

As described above, the screen master 20 with the ink holding layer 21 formed in each pixel 6 is set on the base 12 of the plate making apparatus 10 while setting the side of the gauze 3 upward, the ink is discharged from the side of the gauze 3 by the ink jet head 14 of the plate making apparatus 10, and the ink drops 7 are discharged to each pixel 6 within the range of the image formation.

The ink dropped in each pixel 6 is uniformly held and stabilized while being captured by the ink holding layer 21 in each pixel 6. Thereafter, if the collected visible rays or infrared rays are irradiated onto the ink image by the lamp unit 15 of the plate making apparatus 10, thermal energy is efficiently transmitted to each ink drop 7 of each pixel 6, and the thermoplastic resin film 4 can be perforated in units of pixels 6. Specifically, a high-definition plate making image corresponding to the ink image configured using the ink drops 7 in units of pixels 6 can be obtained. The plate making image thus obtained is basically configured using a set of pixels 6 of the gauze 3 that are fully opened by melting the thermoplastic resin film 4, the resolution is high, and a printed image using this is a high-definition image.

Further, the thermoplastic resin film 4 melted at the intersection points of the fibers 2 of the gauze 3 is entangled and solidified after the plate making, and thus the bonding strength between the fibers 2 of the gauze 3 and the thermoplastic resin film 4 is increased. Further, even if there is an area where the pixel 6 is not fully opened at the boundary of plate making regions, the area is reinforced by the melted film. Thus, it is possible to obtain an effect of preventing delamination in which the film is easily peeled off from the gauze 3 at the area. Further, the screen print is performed in such a manner that the ink is placed on the side of the gauze 3 and squeegeed from the side of gauze 3. In the embodiment, the ink image is formed from the side of the gauze 3, and is heated to perforate the film 4, so that the plate making image is formed. Thus, a normal image can be printed by squeezing from the side of the gauze 3. Specifically, when the plate making image is formed by discharging the ink from the ink jet head 14, it is not necessary to invert the print data.

1, 20 . . . Screen master
2 . . . Fiber
3 . . . Gauze
4 . . . Thermoplastic resin film
5 . . . Attachment point
6 . . . Pixel
7 . . . Ink drop
10 . . . Plate making apparatus
14 . . . Ink jet head as an ink discharge apparatus
15 . . . Lamp unit as an irradiation unit of collected visible rays or infrared rays
21 . . . Ink holding layer

The invention claimed is:

1. A plate making method of a screen master formed by pasting a gauze and a thermoplastic resin film to each other, the method comprising the steps of:

discharging ink by an ink discharge apparatus to form an ink image on the side of the gauze of the screen master; and melting the thermoplastic resin film by heating the ink after irradiating collected visible rays or infrared rays onto the ink image from the side of the gauze to form a plate making image corresponding to the ink image.

2. A plate making method of a screen master formed by pasting a gauze and a thermoplastic resin film to each other, the method comprising the steps of:

forming an ink holding layer made of material having an excellent affinity for ink on the side of the gauze of the screen master;

discharging ink by an ink discharge apparatus to form an ink image on the side of the gauze of the screen master; and melting the thermoplastic resin film by heating the ink after irradiating collected visible rays or infrared rays onto the ink image from the side of the gauze to form a plate making image corresponding to the ink image.

* * * * *